US006887305B2

(12) United States Patent
Larson et al.

(10) Patent No.: US 6,887,305 B2
(45) Date of Patent: May 3, 2005

(54) RELEASE AGENT AND USES FOR SAME

(75) Inventors: Thomas Marshall Larson, Bellaire, TX (US); Allen D. Godwin, Seabrook, TX (US); Bruce R. Lundmark, Houston, TX (US); Anthony James Giaquinto, Houston, TX (US)

(73) Assignee: ExxonMobil Chemical Patents Inc., Houston, TX (US)

( * ) Notice: Subject to any disclaimer, the term of this patent is extended or adjusted under 35 U.S.C. 154(b) by 196 days.

(21) Appl. No.: 10/157,464

(22) Filed: May 29, 2002

(65) Prior Publication Data

US 2003/0221585 A1 Dec. 4, 2003

(51) Int. Cl.[7] ..... G03G 15/20

(52) U.S. Cl. ..... 106/2; 399/325; 106/287.1; 106/287.11; 106/285; 106/270

(58) Field of Search ..... 399/325; 106/2, 106/287.1, 287.11, 285, 270

(56) References Cited

U.S. PATENT DOCUMENTS

| | | | | |
|---|---|---|---|---|
| 3,149,178 A | | 9/1964 | Hamilton et al. | |
| 3,382,291 A | | 5/1968 | Brennan | |
| 3,742,082 A | | 6/1973 | Brennan | |
| 3,769,363 A | | 10/1973 | Brennan | |
| 3,780,128 A | | 12/1973 | Shubkin | |
| 4,172,855 A | | 10/1979 | Shubkin et al. | |
| 4,827,064 A | * | 5/1989 | Wu | 585/10 |
| 4,912,272 A | * | 3/1990 | Wu | 585/10 |
| 4,956,122 A | | 9/1990 | Watts et al. | |
| 5,434,657 A | | 7/1995 | Berkes et al. | 355/273 |
| 5,436,701 A | | 7/1995 | Shimojo et al. | 355/219 |
| 5,459,008 A | * | 10/1995 | Chambers et al. | 430/126 |
| 5,512,409 A | | 4/1996 | Henry et al. | |
| 5,516,361 A | | 5/1996 | Chow et al. | |
| 5,531,813 A | | 7/1996 | Henry et al. | |
| 5,658,999 A | | 8/1997 | Inoue et al. | 526/351 |
| 5,708,950 A | | 1/1998 | Badesha et al. | |
| 5,837,340 A | | 11/1998 | Law et al. | |
| 5,875,381 A | | 2/1999 | Moser | |
| 5,991,590 A | | 11/1999 | Chang et al. | |
| 6,045,961 A | | 4/2000 | Heeks et al. | |
| 6,077,638 A | | 6/2000 | Tanikawa et al. | 430/106 |
| 6,091,924 A | | 7/2000 | Bhattacharya | |
| 6,117,528 A | * | 9/2000 | Hobson et al. | 428/198 |
| 6,141,524 A | | 10/2000 | Berkes et al. | |
| 6,149,832 A | * | 11/2000 | Foister | 252/62.52 |
| 6,253,055 B1 | | 6/2001 | Badesha et al. | |
| 6,336,026 B1 | | 1/2002 | Heeks et al. | 399/302 |

FOREIGN PATENT DOCUMENTS

| | | | |
|---|---|---|---|
| EP | 662645 | | 7/1995 |
| EP | 0691580 A1 | | 1/1996 |
| GB | 1479789 | * | 7/1977 |
| GB | 1479798 | | 7/1977 |
| WO | WO 02/14384 | | 2/2002 |

OTHER PUBLICATIONS

Bott, Donald Dr., *T14 Fusing Technologies in Electrophotographic Systems*, IS&T'S NIP17: The International Conference on Digital Printing Technologies, The Society for Imaging Science and Technology, Oct. 1, 2001, 1–46.
Derwent Database Abstract XP–002253209, 1989.

* cited by examiner

*Primary Examiner*—C. Melissa Koslow
(74) *Attorney, Agent, or Firm*—Louis N. Moreno

(57) ABSTRACT

A release agent for use in imaging systems having hot a fuser roller wherein the release agent is a hydrocarbon.

6 Claims, 2 Drawing Sheets

DT135 / DT6135 FUSER SYSTEM SCHEMATIC

RELEASE AGENT AND USES FOR SAME

FIELD OF THE INVENTION

The present invention relates to a fusing system, method of fusing and release agent for electrostatographic printing machines and methods of using the release agent in electrostatographic printing machines. More specifically, the present invention relates to a fusing system, method of fusing and release agent in electrostatographic printing machines having transfuse of a toner image to a substrate wherein the release agent comprises a polyalpha olefin (hereafter "POA").

BACKGROUND OF THE INVENTION

In a typical electrostatographic reproducing apparatus, a light image of an original to be copied is recorded in the form of an electrostatic latent image upon a photosensitive member. The latent image is subsequently rendered visible by the application of electroscopic thermoplastic resin particles, i.e., toner. The visible toner image is then in a loose powdered form that is easily disturbed or destroyed. The toner image is usually fixed or fused upon a support, which may be the photosensitive member itself or other support such as plain paper.

The use of thermal energy for fixing toner images onto a support member is well known. Fusing electroscopic toner material onto a support surface permanently by heat requires elevating the temperature of the toner material sufficiently to cause the constituents of the toner material to coalesce and become tacky. This heating causes the toner to flow to some extent into the fibers or pores of the support member. As the heated toner material cools and solidifies the toner material firmly bonds to the support.

Typically, toners comprising thermoplastic resin particles are fused to the substrate by heating to a temperature of between about 90° C. to about 160° C. Alternatively, depending upon the softening range of the particular resin used in the toner higher temperatures are used. Raising the temperature of the substrate substantially higher than about 200° C. is undesirable because of the tendency of certain substrates, for example, paper, to discolor at such elevated temperatures.

Several approaches to thermal fusing of electroscopic toner images are known. These methods include the application of heat and pressure substantially concurrently by various means: a rollerer pair maintained in pressure contact; a belt member in pressure contact with a rollerer; and the like. Heat may be applied by heating one or both of the rollerers, plate members or belt members. The fusing of the toner particles occurs when the proper combination of heat, pressure and contact time are provided. Balancing these parameters to fuse the toner particles is well known in the art, and can be adjusted for particular machines or process conditions.

During operation of a fusing system in which heat is applied to cause thermal fusing of the toner particles onto a support, both the toner image and the support pass through a nip formed between the rollerer pair, or plate or belt members. The concurrent transfer of heat and the application of pressure in the nip effect the fusing of the toner image onto the support. It is important in the fusing process that no offset of the toner particles from the support to the fuser member occurs. Toner particles offset onto the fuser member may subsequently transfer to other parts of the machine or onto the support in subsequent copying cycles, thus, increasing the background or interfering with the material being copied there. The so called "hot offset" occurs when the temperature of the toner is raised to a point where the toner particles liquefy and a splitting of the molten toner takes place during the fusing operation with a portion remaining on the fuser member. The hot offset temperature or degradation of the hot offset temperature is a measure of the release property of the fuser rollerer, and accordingly it is desired to provide a fusing surface, which has a low surface energy to provide the necessary release. To ensure and maintain good release properties of the fuser rollerer, it has become customary to apply release agents to the fuser members to ensure that the toner is completely released from the fuser rollerer during the fusing operation. Typically, these materials are applied as thin films of, for example, silicone oils to prevent toner offset.

Silicone oils are commonly used as release agents to aid transfer of the toner image to a substrate. Examples of silicone release agents are disclosed in U.S. Pat. No. 6,253,055B1 (silicone hydride oil); U.S. Pat. No. 5,991,590 (polydimethyl siloxane cationic liquid emulsion); and U.S. Pat. No. 5,531,813 (monoamino functional polyorganosiloxane). Silicone oils have several disadvantages related to thermal decomposition products caused by the high temperatures of the imaging process. The thermal decomposition of organosilicone oils results in the formation of toxic formaldehyde and silicates. The corona wire, which causes the electrostatic charge on an intermediate substrate, which holds the toner prior to transfusing onto a final substrate such as paper, becomes coated with deposits of silicates. Deposits of silicates on the corona wire reduces the efficiency of the corona wire, which results in reduced image quality. Additionally, silicone oils used as release agents are expensive.

Silicone oils also have the disadvantage that the amount of silicone oil needed as a release agent can transfer to the final substrate, such as paper, and prevent ink from adhering to the paper, which interferes with writing notes directly onto the paper. Also, the silicone oil may prevent Post-It™ Notes from adhering to the final substrate for the fused toner. Excess silicone oil causes a person's hands to feel oily after handling a substrate containing the silicone oil used as a toner release agent.

There exists a need for a non-silicone release agent to reduce the formation of formaldehyde and silicates. There exists a need for a less expensive substitute to the expensive silicone oil release agents.

SUMMARY OF THE INVENTION

The present invention provides a release agent that reduces the formation of formaldehyde and silicates. The present invention relates to a fusing system, method of fusing and release agent for electrostatographic printing machines and methods of using the release agent in electrostatographic printing machines. More specifically, the present invention relates to a fusing system, method of fusing and release agent in electrostatographic printing machines having transfuse of a toner image to a substrate wherein the release agent comprises a POA.

Copiers for which the release agent of the present invention may be used include those having imaging processes based on electrostatic, electrophotographic, magnetographic or electron beam technologies.

One embodiment according to the present invention is a release agent comprising a hydrocarbon. Another embodiment according to the present invention is a release agent consisting essentially of a hydrocarbon.

In a preferred embodiment according to the present invention the release agent comprises a hydrocarbon wherein the hydrocarbon comprises a polyalpha olefin. In another preferred embodiment according to the present invention the release agent consists essentially of a hydrocarbon wherein the hydrocarbon comprises a polyalpha olefin.

In another embodiment according to the present invention, the release agent comprises a polyalpha olefin, wherein the polyalpha olefin comprises an oligomer comprising at least one monomer selected from octene, decene, dodecene, and tetradecene.

In another embodiment according to the present invention, the release agent comprises a polyalpha olefin, wherein the polyalpha olefin comprises an oligomer comprising at least one monomer selected from olefins having from 2 carbon atoms to olefins having about 20 carbon atoms.

In another embodiment according to the present invention, the release agent comprises a polyalpha olefin, wherein the polyalpha olefin has a kinematic viscosity from about 2 to about 3,000 Centi-Stokes (cSt), preferably from about 40 cSt to about 1,000 cSt. In another embodiment according to the present invention, the release agent consists essentially of a polyalpha olefin, wherein the polyalpha olefin has a kinematic viscosity from about 2 to about 3,000 Centi-Stokes (cSt), preferably from about 40 cSt to about 3,000 cSt, more preferably from about 40 cSt to about 1,000 cSt, and yet more preferably from about 40 cSt to about 150 cSt.

In another embodiment according to the present invention, the release agent comprises a polyalpha olefin, wherein the polyalpha olefin has a weight average molecular weight ranging from about 226 to about 1188. In another embodiment according to the present invention, the release agent consists essentially of a polyalpha olefin, wherein the polyalpha olefin has a weight average molecular weight ranging from about 226 to about 1188.

In one embodiment according to the present invention the release agent comprises a PAO having a weight average molecular weight/number average molecular weight ratio (Mw/Mn) ranging from about 1.00 to about 2.64, preferably from about 1.00 to about 2.31, more preferably from about 1.00 to about 1.55.

Additionally, the present invention includes methods of reducing toner transfer from the substrate containing the unfused toner to the fuser rollerer during the fusing process to permanently bond the toner to the substrate. One method according to the present invention comprises applying a hydrocarbon, preferably a PAO to the fuser rollerer prior to the hot fuser rollerer contacting the substrate having unfused toner on the surface of the substrate contacting the fuser rollerer. The method comprises applying any individual PAO described above or combination of PAOs described above.

DESCRIPTION OF THE INVENTION

Figure 1:
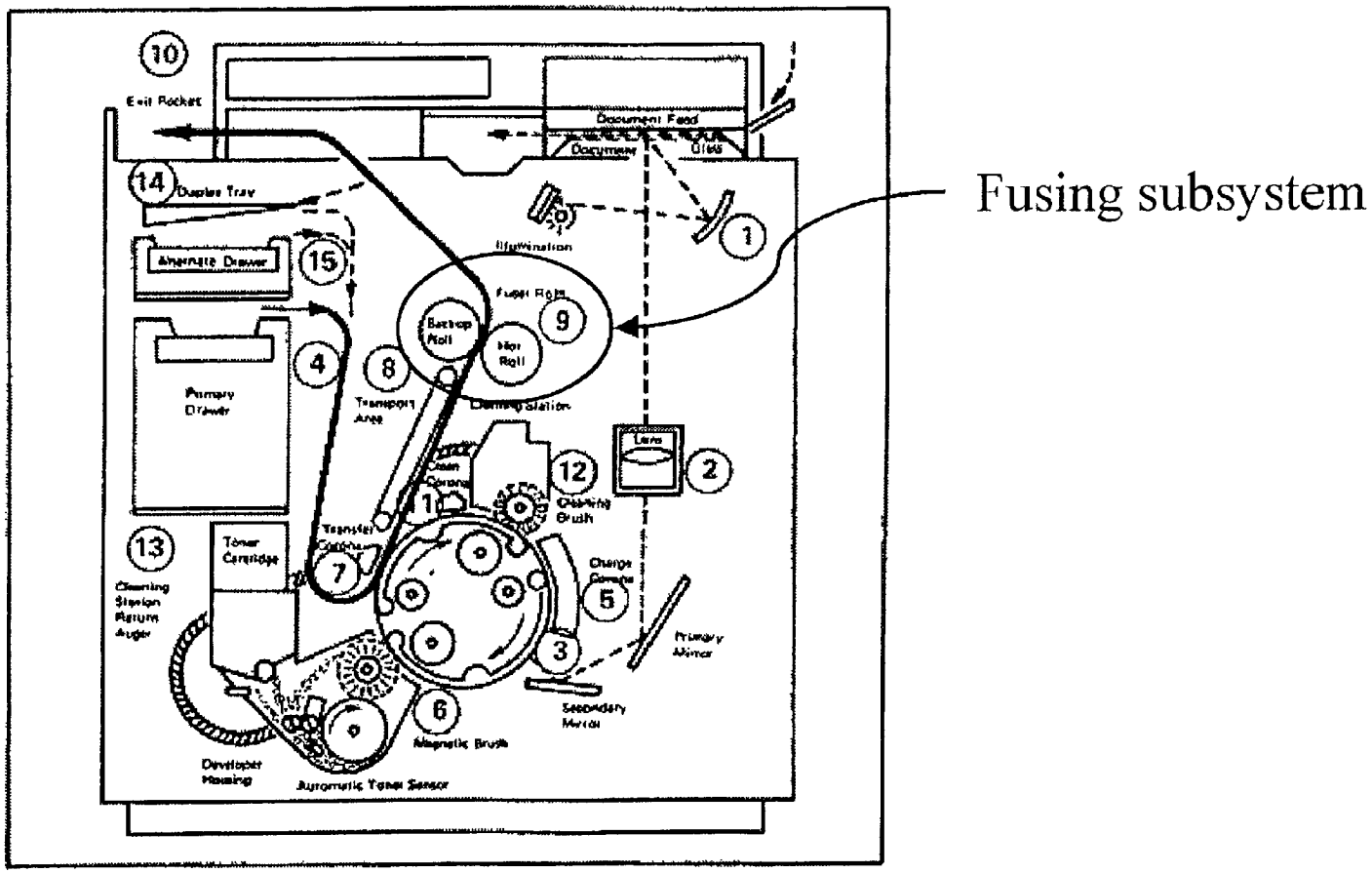
FIG. 1 shows a schematic of an analog electrophotograph.

The present invention provides a release oil composition with improved properties relative to conventional silicone oils used as release agents. The present invention comprises a hydrocarbon release agent that reduces formaldehyde and silicate decomposition by-products that are typical of organosilicone oil release agents.

One embodiment according to the present invention is a release oil composition comprising a hydrocarbon. In one preferred embodiment the hydrocarbon comprises a polyalpha olefin (PAO). PAOs are made by oligomerizing alpha olefins by known methods exemplified, but not limited to, methods disclosed in U.S. Pat. Nos. 3,149,178; 3,382,291; 3,742,082; 3,769,363; 3,780,128; 4,172,855 and 4,956,122 which are incorporated by reference for the methods of preparing PAOs. PAOs are also discussed in Lubrication Fundamentals, J. G. PAO Wills, Marcel Dekker Inc., (New York, 1980). The PAO oligomers include dimers, trimers, tetramers, pentamers, hexamers and higher oligomers. The PAOs are typically mixtures of oligomers, but individual oligomers or selected groups of oligomers may be obtained by conventional purification processes including, but not limited to, distillation and solvent extraction. Preferably, the PAOs are substantially free of the monomer or mixture of monomers used to prepare the PAOs.

In another embodiment according to the present invention, the release agent comprises a polyalpha olefin, wherein the polyalpha olefin comprises an oligomer comprising at least one monomer selected from octene, decene, dodecene, and tetradecene. In another embodiment according to the present invention, the release agent consists essentially of a polyalpha olefin, wherein the polyalpha olefin comprises an oligomer comprising at least one monomer selected from octene, decene, dodecene, and tetradecene.

In another embodiment according to the present invention, the release agent comprises a polyalpha olefin, wherein the polyalpha olefin comprises an oligomer comprising at least one monomer selected from olefins having from 2 carbon atoms to olefins having about 20 carbon atoms. In another embodiment according to the present invention, the release agent consists essentially of a polyalpha olefin, wherein the polyalpha olefin comprises an oligomer comprising at least one monomer selected from an alpha-olefin having from 2 carbon atoms to about 20 carbon atoms.

In one embodiment according to the present invention, the PAOs comprise homo-oligomers prepared from a single alpha-olefin monomer. In another embodiment according to the present invention, the PAOs comprise co-oligomers prepared from at least two alpha-olefin monomers. Linear alpha-olefin monomers are preferred, but branched alpha-olefins may also be used to prepare the PAOs. Mixtures of linear and branched alpha-olefins may also be used to prepare the PAOs.

It is known that some processes for preparing PAOs from linear alpha-olefins causes a portion of the double bond to migrate from a terminal position to an internal position in the carbon chain of the monomer. The internal olefin is incorporated into the PAO and introduces branching in which the length of the branches depends on the location of the internal double bond when the internal olefin reacts to form a PAO. PAOs incorporating the internal olefins that are created in situ are within the scope of the present invention. Furthermore, the addition of internal olefins to the feed mixture used to prepare the PAOs is also within the scope of the present invention.

In one embodiment according to the present invention the release agent comprises a PAO having a weight average molecular weight/number average molecular weight ratio (Mw/Mn) ranging from about 1.00 to about 2.64, preferably from about 1.00 to about 2.31, more preferably from about 1.00 to about 1.55.

In one embodiment according to the present invention the release agent comprises a PAO having a weight average molecular weight (Mw) ranging from about 226 to about 55,100, preferably from about 226 to about 6790, more preferably from about 226 to about 2720. In one embodiment according to the present invention the release agent consists essentially a PAO having a weight average molecular weight (Mw) ranging from about 226 to about 55,100, preferably from about 226 to about 6790, more preferably from about 226 to about 2720.

In one embodiment according to the present invention the release agent comprises a PAO having a number average molecular weight (Mn) ranging from about 280 to about 20,900, preferably from about 280 to about 2900, more preferably from about 280 to about 1700. In one embodiment according to the present invention the release agent consists essentially of a PAO having a number average molecular weight (Mn) ranging from about 280 to about 20,900, preferably from about 280 to about 2900, more preferably from about 280 to about 1700.

In one embodiment according to the present invention the release oil composition comprises a mixture of PAOs and conventional silicone oil release agents and derivatized silicone oil release agents. The PAOs comprise from about 0.1 wt % to about 99 wt % of the mixture, based on the total weight of the mixture. In a preferred embodiment according to the present invention, the PAOs comprise from about 0.1 wt % to about 10 wt % of the mixture of PAOs and conventional silicone release agents. In a more preferred embodiment according to the present invention, the PAOs comprise from about 0.1 wt % to about 1 wt % of the mixture of PAOs and the conventional silicone release agents. In another embodiment according to the present invention, the PAOs in the mixture of PAOs and conventional silicon release agent may comprise any individual PAOs described above or any combination of two or more of the PAOs described above. PAOs having a kinematic viscosity of about 2 cSt are particularly preferred for use in the release oil composition comprising a mixture of a PAO and a conventional silicone oil release agent.

The release agent according to the present invention can be used with conventional copiers using rollerer-fusing methods. Rollerer fusing methods include (a) hard fuser rollerer (FR) and soft pressure rollerer (PR), conventionally termed NFPR; (b) soft FR and hard PR, conventionally termed NFFR (c) conformable hard FR and soft PR, conventionally termed NFPR; and (d) soft FR and soft PR.

FIG. 1 shows a conventional copier in which release agents according to the present invention may be used. In a typical copier an illumination source illuminates the document to be copied. The light reflected from the illuminated document is conveyed by a series of mirrors to a photosensitive member. The photosensitive member has previously been electrostatically charged by a corona wire. The electrostatic charge is substantially uniform on the surface of the photosensitive member. The light directed to the photosensitive member discharges the electrostatic charge and leaves a charge that is a latent image of the document to be copied. The partially charged photosensitive member becomes visible by attracting toner particles. The toner particles on the photosensitive member are transferred to a substrate such as paper by direct contact of the paper and photosensitive member. The toner particles are permanently bonded to the paper by passing the paper with the toner through a fuser subsystem.

Figure 2:
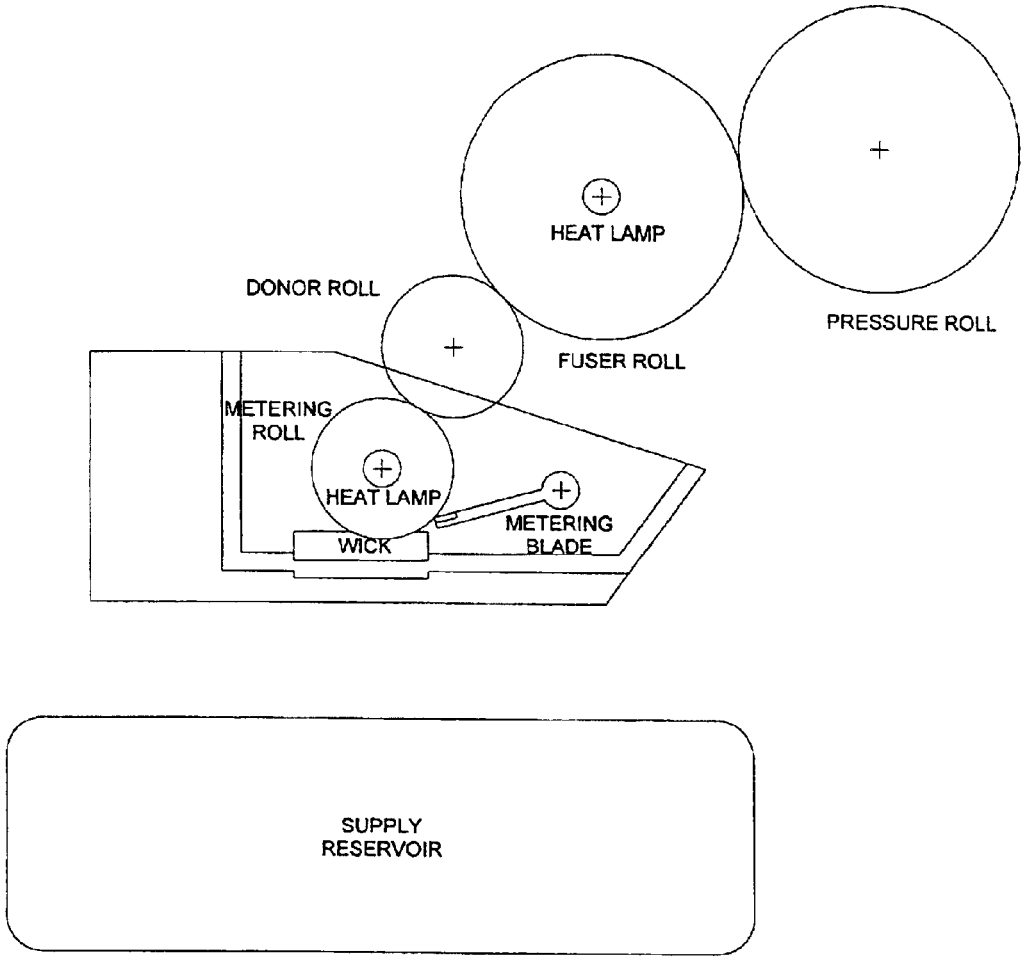
FIG. 2 shows a schematic of a fuser assembly system.

The fuser subsystem is shown in FIG. 2. Typically a release agent is applied to the fuser rollerer to prevent the toner from adhering to the fuser rollerer. The release agent may be applied directly to the fuser rollerer or indirectly as shown in FIG. 2. In one embodiment, one release agent according to the present invention is maintained in a supply reservoir. The release agent is transferred to a metering rollerer by any conventional method including, but not limited to, a wick or a pump. A metering blade is used to limit the amount of release agent on the metering rollerer. The metering rollerer contacts a donor rollerer and a portion of the release agent is transferred to the donor rollerer. The donor rollerer is also in contact with the fuser rollerer and a portion of the release agent is transferred from the donor rollerer to the fuser rollerer. Typically this is a continuous process. The substrate, typically paper, having the unfused toner passes between the fuser rollerer, which is hot, and a pressure rollerer. The toner is on the side of the paper contacting the hot fuser rollerer. The release agent on the hot fuser rollerer reduces or prevents transfer of the toner from the substrate to the hot fuser rollerer.

In one embodiment according to the present invention, a method of reducing toner transfer from a substrate having unfused toner to a hot fuser rollerer comprises applying a release agent to the hot fuser rollerer prior to contact of the hot fuser rollerer with the substrate having unfused toner wherein the release agent comprises a hydrocarbon. In another embodiment according to the present invention, a method of reducing toner transfer from a substrate having unfused toner to a hot fuser rollerer comprises applying a release agent to the hot fuser rollerer prior to contact of the hot fuser rollerer with the substrate having unfused toner wherein the release agent consists essentially of a hydrocarbon. In a preferred embodiment, the method of reducing toner transfer comprises indirectly applying the release agent to the hot fuser rollerer by applying the release agent to a metering role, transfer of the release agent from the metering rollerer to a donor rollerer and transfer of the release agent from the donor rollerer to the hot fuser rollerer. In another preferred embodiment, the method further comprises adjusting the amount of release agent on the metering rollerer by maintaining a metering blade at a distance from the metering rollerer to remove a portion of the release agent applied to the metering rollerer.

In a preferred embodiment according to the present invention the method of reducing toner transfer to the fuser rollerer comprises applying a release agent comprising a hydrocarbon to the hot fuser rollerer, wherein the hydrocarbon comprises a polyalpha olefin. In a preferred embodiment according to the present invention the method of reducing toner transfer to the fuser rollerer comprises applying a hydrocarbon to a hot fuser rollerer, wherein the hydrocarbon consists essentially of a polyalpha olefin. The polyalpha olefin may be applied directly or indirectly, as described above, to the fuser rollerer.

In another embodiment according to the present invention, the method of reducing toner transfer to a fuser role comprises applying a release agent comprising a polyalpha olefin to the fuser rollerer, wherein the polyalpha olefin comprises an oligomer comprising at least one monomer selected from olefins having from 2 carbon atoms to olefins having about 20 carbon atoms. In another embodiment according to the present invention, the method of reducing toner transfer to a fuser rollerer comprises applying a release agent consists essentially of a polyalpha olefin to the fuser rollerer, wherein the polyalpha olefin comprises an oligomer comprising at least one monomer selected from an alpha-olefin having from 2 carbon atoms to about 20 carbon atoms.

In a preferred embodiment according to the present invention, the method of reducing toner transfer to the fuser rollerer comprises applying a release agent to a toner fuser rollerer wherein the PAO comprises an oligomer comprising at least one monomer selected from octene, decene, dodecene, and tetradecene. In another embodiment according to the present invention, the method of reducing toner transfer to the fuser rollerer comprises applying a release agent to a toner fuser rollerer wherein the PAO consists essentially of a polyalpha olefin, wherein the polyalpha olefin comprises an oligomer comprising at least one monomer selected from octene, decene, dodecene, and tetradecene.

In one embodiment according to the present invention, the method of reducing toner transfer to the fuser rollerer comprises applying a release agent to a toner fuser rollerer wherein the PAO has a weight average molecular weight/number average molecular weight ratio (Mw/Mn) ranging from about 1.00 to about 2.64, preferably from about 1.00 to about 2.31, more preferably from about 1.00 to about 1.55.

In another embodiment according to the present invention, the method of reducing toner transfer to the fuser rollerer comprises applying a release agent to a toner fuser rollerer wherein the PAO has a weight average molecular weight (Mw) ranging from about 280 to about 55,100, preferably from about 280 to about 6790, more preferably from about 280 to about 2720. In another embodiment according to the present invention, the method of reducing toner transfer to the fuser rollerer comprises applying a release agent to a toner fuser rollerer wherein the PAO has a weight average molecular weight (Mw) ranging from about 280 to about 55,100, preferably from about 280 to about 6790, more preferably from about 280 to about 2720.

In another embodiment according to the present invention, the method reducing toner transfer to fuser rollerer comprise applying release agent to a fuser rollerer wherein the release agent comprises a polyalpha olefin, wherein the polyalpha olefin has a kinematic viscosity from about 2 to about 3,000 Centi-Stokes (cSt), preferably from about 40 cSt to about 1,000 cSt. In another embodiment according to the present invention, the method of reducing toner transfer to a fuser rollerer comprises applying a release agent to a fuser rollerer wherein the release agent consists essentially of a polyalpha olefin, wherein the polyalpha olefin has a kinematic viscosity from about 2 to about 3,000 cSt, preferably from about 40 cSt to about 3,000 cSt, more preferably from about 40 cSt to about 1,000 cSt, and yet more preferably from about 40 cSt to about 150 cSt. In one embodiment according to the present invention, the method of reducing toner transfer to the fuser rollerer comprises applying a release agent to a toner fuser rollerer wherein the release oil composition comprises a mixture of PAOs and conventional silicone oil release agents and derivatized silicone oil release agents.

In another embodiment according to the present invention, the method of reducing toner transfer to the fuser rollerer comprises applying a release agent to a toner fuser rollerer wherein the release oil composition comprises a mixture of PAOs and conventional silicone oil release agents and derivatized silicone oil release agent wherein the PAOs comprise from about 0.1 weight % to about 99-weight % of the mixture, based on the total weight of the mixture. In a more preferred method of reducing toner transfer to the fuser rollerer, the PAOs comprise from about 0.1 wt % to about 10-wt % of the mixture of PAOs and conventional silicone release agent. In another preferred method, the PAOs comprise from about 0.1 wt % to about 1 wt % of the mixture of PAOs and the conventional silicone release agent.

In another embodiment according to the present invention, the method of reducing toner transfer to the fuser roller comprises applying a release agent to a toner fuser roller wherein the release oil composition comprises a mixture of PAOs and at least one of a silicone oil, organosilicone oil, sulfur-containing organosilicone oil and an nitrogen-containing silicone oil.

While the invention has been explained in relation to its preferred embodiments, it is to be understood that various modifications thereof will become apparent to those skilled in the art upon reading the specification. Therefore, it is to be understood that the invention disclosed herein is intended to cover such modifications as fall within the scope of the appended claims.

What is claimed:

1. A method of reducing toner transfer to a fuser roller comprising applying a release agent to the fuser roller, where in the release agent comprises a polyalpha olefin having viscosity of from about 2 cSt to about 3,000 cSt.

2. The method according to claim 1, wherein the polyalpha olefin comprises an oligomer comprising at least one monomer selected from octene, decene, dodecene and tetradecene.

3. The method according to claim 1, wherein the polyalpha olefin has a polydispersity (Mw/Mn) of from about 1.00 to about 2.64.

4. The method according to claim 1, wherein the polyalpha olefin has a weight average molecular weight of from about 226 to about 55,100.

5. The method according to claim 1, wherein the polyalpha olefin has a number average molecular weight of from about 280 to about 20,900.

6. The method according to claim 1 wherein the release agent further comprises at least one of a silicone oil, organosilicone oil, sulfur-containing organosilicone oil and an nitrogen-containing silicone oil.

* * * * *